US005618403A

United States Patent [19]

de Nora et al.

[11] Patent Number: 5,618,403

[45] Date of Patent: Apr. 8, 1997

[54] MAINTAINING PROTECTIVE SURFACES ON CARBON CATHODES IN ALUMINIUM ELECTROWINNING CELLS

[75] Inventors: Vittorio de Nora, Nassau, Bahamas; Jean-Jacques Duruz, Geneva, Switzerland

[73] Assignee: Moltech Invent S.A., Luxembourg, Luxembourg

[21] Appl. No.: 511,647

[22] Filed: Aug. 7, 1995

[51] Int. Cl.[6] ..... C25C 3/08; C25C 3/14

[52] U.S. Cl. ..... 205/372; 205/389; 205/392; 204/243 R; 204/245; 204/294

[58] Field of Search ..... 204/243 R–247, 204/294; 205/372, 389, 392

[56] References Cited

U.S. PATENT DOCUMENTS

| | | | |
|---|---|---|---|
| 2,915,442 | 11/1955 | Lewis | 205/387 |
| 3,028,324 | 4/1962 | Ransley et al. | 205/374 |
| 3,156,639 | 11/1964 | Kibby | 204/243 R |
| 3,215,615 | 11/1965 | Ransley | 204/279 |
| 3,274,093 | 9/1966 | McMinn | 204/243 R |
| 3,314,876 | 4/1967 | Ransley | 204/291 |
| 3,330,756 | 7/1967 | Ransley | 204/279 |
| 3,400,061 | 9/1968 | Lewis et al. | 205/375 |
| 4,544,457 | 10/1985 | Sane et al. | 204/243 R |
| 4,560,448 | 12/1985 | Sanel et al. | 205/372 |
| 4,681,671 | 7/1987 | Duruz | 205/376 |
| 5,004,524 | 4/1991 | Duruz | 204/243 R |
| 5,227,045 | 7/1993 | Townsend | 205/230 |
| 5,486,278 | 1/1996 | Manganiello et al. | 204/243 R |

*Primary Examiner*—Donald R. Valentine
*Attorney, Agent, or Firm*—Dinsmore & Shohl

[57] ABSTRACT

A cell for the electrowinning of aluminium by the electrolysis of alumina dissolved in a molten fluoride-based electrolyte comprises a cathode composed of a carbon body having an aluminium resistant aluminium-wettable surface layer containing particulate titanium or other refractory hard metal boride and a bonding material providing a porous layer which contains cathodic molten aluminium. Molten cathodic aluminium external to the aluminium-resistant and aluminium-wettable surface contains refractory hard metal and boron in a total concentration sufficient or just below that sufficient to inhibit dissolution into the molten aluminium of the refractory hard metal boride. Alumina is fed to the cell whereby the required amount of titanium in the aluminium results from the alumina feed while, when boron is not present in a sufficient amount, boron is added to bring the total titanium and boron content to or just below the equilibrium solubility product.

16 Claims, No Drawings

MAINTAINING PROTECTIVE SURFACES ON CARBON CATHODES IN ALUMINIUM ELECTROWINNING CELLS

FIELD OF THE INVENTION

The invention relates to the electrowinning of aluminium by the electrolysis of alumina dissolved in a molten fluoride-based electrolyte in a cell comprising a cathode composed of a carbon body having an aluminium-wettable surface layer containing particulate refractory hard metal boride.

The invention particularly relates to maintaining such a layer as an aluminium resistant layer by controlled levels of refractory hard metal and boron in the aluminium.

BACKGROUND OF THE INVENTION

Aluminium is produced conventionally by the Hall-Héroult process, by the electrolysis of alumina dissolved in cryolite-based molten electrolytes at temperatures up to around 950° C. A Hall-Héroult reduction cell typically has a steel shell provided with an insulating lining of refractory material, which in turn has a lining of carbon which contacts the molten constituents. Conductor bars connected to the negative pole of a direct current source are embedded in the carbon cathode substrate forming the cell bottom floor. The cathode substrate is usually a carbon lining made of prebaked anthracite-graphite or all graphite cathode blocks, joined with a ramming mixture of anthracite, coke, and coal tar.

In Hall-Héroult cells, a molten aluminium pool acts as the cathode. The carbon lining or cathode material has a useful life of three to eight years, or even less under adverse conditions. The deterioration of the cathode bottom is due to erosion and penetration of electrolyte and liquid aluminium as well as intercalation of sodium, which causes swelling and deformation of the cathode carbon blocks and ramming mix. In addition, the penetration of sodium species and other ingredients of cryolite or air leads to the formation of toxic compounds including cyanides.

Difficulties in operation also arise from the accumulation of undissolved alumina sludge on the surface of the carbon cathode beneath the aluminium pool which forms insulating regions on the cell bottom. Penetration of cryolite and aluminium through the carbon body and the deformation of the cathode carbon blocks also cause displacement of such cathode blocks. Due to cracks in the cathode blocks, aluminium reaches the steel cathode conductor bars causing corrosion thereof leading to deterioration of the electrical contact, non uniformity in current distribution and an excessive iron content in the aluminium metal produced.

A major drawback of carbon as cathode material is that it is not wetted by aluminium. This necessitates maintaining a deep pool of aluminium (100–250 mm thick) in order to ensure a certain protection of the carbon blocks and an effective contact over the cathode surface. But electromagnetic forces create waves in the molten aluminium and, to avoid short-circuiting with the anode, the anode-to-cathode distance (ACD) must be kept at a safe minimum value, usually 40 to 60 mm. For conventional cells, there is a minimum ACD below which the current efficiency drops drastically, due to short-circuiting between the aluminium pool and the anode or to oxidation of the aluminium. The electrical resistance of the electrolyte in the inter-electrode gap causes a voltage drop from 1.8 to 2.7 volts, which represents from 40 to 60 percent of the total voltage drop, and is the largest single component of the voltage in a given cell.

To reduce the ACD and associated voltage drop, extensive research has been carried out with Refractory Hard Metals or Refractory Hard Materials (RHM) such as $TiB_2$ as cathode materials. $TiB_2$ and other RHM's are practically insoluble in aluminium, have a low electrical resistance, and are wetted by aluminium. This should allow aluminium to be electrolytically deposited directly on an RHM cathode surface, and should avoid the necessity for a deep aluminium pool. Because titanium diboride and similar Refractory Hard Metals are wettable by aluminium, resistant to the corrosive environment of an aluminium production cell, and are good electrical conductors, numerous cell designs utilizing Refractory Hard Metal have been proposed, which would present, many advantages, notably including the saving of energy by reducing the ACD.

The use of titanium diboride and other RHM current-conducting elements in electrolytic aluminium production cells is described inter alia in U.S. Pat. Nos. 2,915,442, 3,028,324, 3,215,615, 3,314,876, 3,330,756, 3,156,639, 3,274,093 and 3,400,061. Despite extensive efforts and the potential advantages of having surfaces of titanium diboride at the cell cathode bottom, such propositions have not been commercially adopted by the aluminium industry.

U.S. Pat. No. 4,544,457 (Sane) discloses a drained cathode for an aluminium production cell having an apertured sheath of corrosion-resistant material which closely conforms to the cathode surface and retains molten aluminium in stagnant contact with the cathode surface.

U.S. Pat. No. 3,028,324 (Ransley) proposed to immerse titanium diboride structures in molten aluminium and reduce the dissolution of titanium diboride by maintaining a concentration of titanium and boron in the molten aluminium.

U.S. Pat. No. 4,560,448 (Sane) proposed coating refractory non-carbon bodies with a thin coating of titanium diboride which was maintained, when the bodies were immersed in a cathodic aluminium pool of an aluminium electrowinning cell, by maintaining a concentration of titanium and boron in the molten aluminium sufficient to inhibit dissolution of the titanium diboride.

However, this principle has not been applied successfully to carbon cathodes coated with refractory hard metal borides.

To avoid the problems encountered with carbon cathodes coated with refractory hard metal borides, U.S. Pat. No. 5,227,045 (Townsend) proposed a development of the above idea where a drained carbon cathode having a titanium diboride coating in a carbon binder was protected by maintaining a supersaturated concentration of titanium and boron in the molten aluminium film sufficient to deposit a protective titanium diboride coating at a rate of about 0.01 to 2 cm per year.

This U.S. Pat. No. 5,227,045 examines the effects of operation with differing titanium and boron levels in the molten aluminium film and shows that, below saturation of titanium diboride in the molten aluminium, titanium diboride dissolves. Moreover, according to this patent, at below 200 ppm titanium there is a reaction between aluminium and carbon to form AlC, and TiC dissolves. At above 200 ppm titanium, dissolved titanium reacts with carbon and AlC to form TiC.

Also, it was found that, even just above the saturation of titanium diboride in the molten aluminium, at below 200 ppm Ti, there is still a reaction between aluminium and carbon to form AlC, which disrupts deposit of titanium diboride so it deposits too slow to form a protective coating. At above 200 ppm titanium, dissolved titanium reacts with carbon to form TiC, and titanium diboride still deposits tool slow to form a protective coating.

Thus, the carbon cathodes with titanium diboride/carbon coatings were found to be insufficient to resist dissolution and disintegration in the absence of a permanently grown protective titanium diboride deposit produced under constant supersaturation conditions. With levels of titanium and boron below or just above the saturation limit, the coatings were found to be unstable and could not be maintained for long periods.

Following this teaching therefore leads away from preventing dissolution of titanium diboride coatings on carbon-based cathodes by maintaining titanium and boron in the molten aluminium below a supersaturated condition at which titanium diboride permanently grows onto the surface.

Moreover, the production of aluminium for certain applications, for instance to make very thin aluminium foils, allows only a very low tolerance of boron, and the precipitation of titanium diboride crystals would be highly disadvantageous. For such applications, operating under supersaturation conditions according to U.S. Pat. No. 5,227,045 would be ruled out.

SUMMARY OF THE INVENTION

Because of the usefulness to have a protective aluminium-resistant and aluminium-wettable surface on a carbon cathode, an object of the invention is to provide an aluminium electrowinning cell and method using a carbon cathode with a protective aluminium-resistant surface based on titanium diboride with a non-carbon (i.e. a non organic) bonding, which surface can be maintained permanently even with low levels of titanium and boron in the molten aluminium. By "aluminium-resistant" surface is meant a titanium diboride surface which is inert to reaction with molten aluminium and which is maintained stable in molten aluminium containing titanium and boron in a quantity which inhibits dissolution of the surface or in which the dissolution of $TiB_2$ takes place very slowly.

it is also an object of the invention to maintain such a protective aluminium-resistant surface based on titanium diboride with a non-carbon bonding with an amount of titanium in the molten aluminium which results from the alumina feed and by adding boron, when required, in an amount to maintain a total quantity of titanium and boron in the molten aluminium which corresponds to the equilibrium solubility product of titanium diboride, i.e. can be just sufficient to prevent dissolution of titanium diboride, or is just below that value.

The invention applies mainly to aluminium electrowinning cells operating with a deep pool of molten aluminium, but applies also to cells operating in a drained cathode configuration.

According to the invention, a cell for the electrowinning of aluminium by the electrolysis of alumina dissolved in a molten fluoride-based electrolyte comprises a cathode composed of a carbon body having an aluminium-resistant and aluminium-wettable surface layer containing particulate refractory hard metal boride and a bonding material forming a porous coating, more particularly a bonding material containing colloidal alumina.

The bonding material typically comprises at least one colloid selected from colloidal alumina, silica, yttria, ceria, thoria, zirconia, magnesia, lithia, monoaluminium phosphate or cerium acetate.

Typically, the aluminium-resistant and aluminium-wettable surface has a porosity of about 20% to about 40% and is produced by applying one or more layers of particulate refractory hard metal boride and bonding material followed by heat treatment.

The porous coating of titanium diboride and the binder, preferably colloidal alumina, is in contact with the molten cathodic aluminium and retains a stagnant film of molten aluminium within the pores of the coating. This film of molten aluminium improves the conductivity of the coating and moreover contributes to consolidation of the porous surface during use of the cell. Furthermore, the molten aluminium inside the porous surface contains dissolved titanium and boron with a concentration gradient which increases toward the inside.

To permanently maintain the aluminium resistant layer on the cathode, the molten cathodic aluminium external to the aluminium-resistant surface of the carbon cathode contains refractory hard metal and boron from the cell feedstock in a concentration sufficient to inhibit dissolution into the molten aluminium of the refractory hard metal boride of the aluminium-resistant surface layer of the cathode, or is just below that value.

Impregnation of the porous aluminium-resistant and aluminium-wettable surface with molten aluminium results in improved resistance of the cathode coating to attack by molten aluminium, making it possible to operate the cell with the addition in the cell feedstock of titanium and/or boron compounds which produce a low level of titanium and a low level boron in the product molten aluminium which is at or possibly just below that required for zero dissolution of titanium diboride from the cathode coating.

Such concentration of titanium and boron provided from the feedstock is just sufficient to prevent or decrease dissolution of the coating and serves to maintain a permanent and stable protective coating on the cathode for long periods of time without substantially disrupting operation of the cell and in particular without undesirably contaminating the product aluminium.

The equilibrium solubility product corresponds to a titanium content and a boron content in the molten aluminium which correspond to a value at which the coating surface is in equilibrium: no dissolution and no deposit of titanium diboride takes place.

In certain cases, described below, the additions of boron and titanium from the cell feedstock may be slightly above the values required for zero dissolution, but are nevertheless at or below levels corresponding to slow dissolution of the coating.

Very surprisingly, it has been found that even when the level of the fed titanium and boron in the product aluminium is just below the solubility product, the coating remains stable for extremely long periods. This is believed to be due to two factors. On the one hand the aluminium inside the porous coating has a higher titanium and boron level which provides a protective effect, leaving only the grains on the outside surface of the coating exposed to the product aluminium. On the other hand, there is a possible formation of stable compounds in the coating between the binder and the titanium diboride, particularly when the binder is colloidal alumina. A reduced solubility of such compounds could help explain the unexpectedly long lifetimes achieved.

The invention also provides a method of electrowinning aluminium in the cell as discussed above, wherein the aluminium-resistant and aluminium-wettable surface of the carbon cathode contains particulate refractory hard metal boride, especially titanium diboride, and a bonding material, especially colloidal alumina, forming a porous coating which retains a film of molten aluminium within the pores of the coating.

In this method, alumina with a given titanium content is fed to the cell whereby the presence of titanium usually results from the alumina feed. In the usual case when boron is not present in a sufficient amount, a boron compound is added to the alumina feed to bring the total fed titanium and boron content in the product aluminium up to or just below the equilibrium solubility product.

In this usual case, the presence of titanium results from the alumina feed while, when boron is not present in a sufficient amount, boron is added to the feed. In other cases, titanium alone or boron and titanium can be added to the feed in the required amounts.

During operation, the quantity of titanium and boron in the product aluminium is measured to monitor operation of the cell. When titanium and/or boron compounds are fed in an amount to provide a level of titanium and boron in the product aluminium which is below the solubility product, measurement of the titanium and boron levels in the product aluminium provides an indication of the expected lifetime of the cathode coating.

In any event, whenever there is a change in the alumina feed, the quantity of titanium and boron in the new aluminium feed is checked and the amount of boron and/or titanium added is adjusted accordingly.

The equilibrium solubility of $TiB_2$ in molten aluminum at 970° C. is given by the equation:

$$[Ti]\cdot[B]^2=9\cdot10^3 \text{ (in ppm) (or } 0.9\cdot10^{-8} \text{ in weight \%).}$$

To satisfy this equation, when the titanium content in the molten aluminium is 35 ppm, the boron content must be 16 ppm to avoid dissolution of the titanium diboride.

Assuming an aluminum production of 1200 kg/day/per cell and no titanium or boron is introduced in the electrolyte, the amount of Ti and B contained in the aluminium produced per day corresponds to (35+16)=51 ppm times the amount of aluminium produced per day, i.e.:

$$51\cdot10^{-6}\cdot1200=6\cdot10^{-2} \text{ kg/day or 22.3 kg/year.}$$

This corresponds to $1.9\cdot10^{-2}$ kg/day or 7 kg/year of boron and $4.2\cdot10^{-2}$ kg/day or 15.3 kg/year of titanium.

Dissolution of $TiB_2$ may for example be suppressed by maintaining a concentration of 35 ppm titanium and 16 ppm boron in molten aluminum.

The titanium addition may normally be made through the alumina feed which contains sufficient titanium to maintain an adequate concentration. Typical titanium concentrations resulting from the alumina feed range from 20 to 55 ppm. Boron levels are significantly lower than the levels required to avoid the dissolution and range typically from 3 to 6 ppm, which is well below the threshold value of 16 ppm when 35 ppm of titanium are present.

Therefore, to reach the solubility product, for the given alumina feed, about 10 to 13 ppm of boron should be added, for example by adding $B_2O_3$ to the bath.

Addition of 10 ppm of boron would require $1.2\cdot10^{-2}$ kg/day/cell of boron. This corresponds to $3.8\cdot10^{-2}$ kg/day/cell of $B_2O_3$ or $6.5\cdot10^{-2}$ kg/day/cell of $H_3BO_3$.

The Table below sets out the required concentration of boron, and the corresponding total concentration of boron and titanium, to maintain a $TiB_2$ solubility product of $9\cdot10^3$ ppm ($0.9\cdot10^{-8}$ wt %) at various titanium concentrations in molten aluminium at 970° C.

TABLE

THE REQUIRED CONCENTRATION OF BORON, AND THE CORRESPONDING TOTAL CONCENTRATION OF BORON AND TITANIUM, AT VARIOUS TITANIUM, CONCENTRATIONS:

| Ti conc. in Al ppm | B conc. in Al ppm | Total conc. in Al ppm |
|---|---|---|
| 5 | 42.5 | 47.5 |
| 10 | 30.0 | 40.0 |
| 20 | 21.0 | 41.0 |
| 30 | 17.0 | 47.0 |
| 35 | 16.0 | 51.0 |
| 40 | 15.0 | 55.0 |
| 50 | 13.5 | 63.5 |
| 60 | 12.5 | 72.5 |
| 70 | 11.5 | 81.5 |
| 80 | 10.5 | 90.5 |
| 90 | 10.0 | 100.0 |
| 100 | 9.5 | 109.5 |
| 150 | 9.0 | 159.0 |
| 200 | 6.7 | 206.7 |
| 360 | 5.0 | 365.0 |

For most applications, an acceptable level of boron in aluminum is 50 ppm. The acceptable level of titanium in aluminium depends on the end use and is normally less than 200 ppm.

One aspect of the invention is based on the insight that, at lower titanium and boron feed concentrations in aluminum resulting from the feed, $TiB_2$ dissolution could be more effectively controlled by adding boron instead of titanium to the feed.

For the typical titanium concentrations resulting from the alumina feed, from 20 to 55 ppm, the corresponding required boron concentration is from about 21 to 13 ppm, which means adding from about 7 to 18 ppm of boron depending on the normal content in the range of 3 to 6 ppm.

The "background level" of titanium and boron produced by a given alumina feedstock is known from measurements taken with conventional cells with a carbon cathode, and can also be calculated by analysis of the alumina feedstock. Knowing this background level, it is possible to add a calculated amount of a boron source (or a source of boron and titanium or of titanium alone) to the alumina feedstock to bring the level of fed titanium and boron in the aluminium up to or just below the solubility product. This can be achieved for example by adding boron oxide and titanium oxide to the alumina feed daily or at regular intervals, or feeding them in parallel with the alumina feed.

In a particular method according to the invention, the cell is initially operated with an alumina feedstock which provides a known level of titanium and boron in the product aluminium, well below the solubility product. Once the cell reaches steady operation, the levels of titanium and boron in the product aluminium are measured. Then, at least one compound of titanium and boron is added to the alumina feed in an amount to bring the resulting level of titanium and boron in the product aluminium from the feed up to or just below the said measured value. Operation in then continued with addition of the calculated amount of the titanium and/or boron compound to the alumina feed.

In this method, if the aforesaid measured level of titanium and boron is slightly above the solubility product, the amount of added compound(s) is calculated to bring the resulting level of titanium and boron in the product aluminium from the feed up to the measured values.

If the measured level of titanium and boron is slightly above the solubility product, the amount of added compound(s) is calculated to bring the resulting level of titanium and boron in the product aluminium from the feed up to or close to the solubility product. In this case, the amount of boron and titanium added in the feed may even slightly exceed the solubility product, i.e. up to the measured level, which corresponds to a very slow dissolution of the coating.

When the measured level of titanium and boron is slightly below the solubility product, the amount of added compound(s) is calculated to bring the resulting level of titanium and boron in the product aluminium from the feed up to or slightly below the solubility product.

In any event, the amount of the compound(s) added is adjusted whenever there is a change in the alumina feedstock.

EXAMPLE

Cathode Coating

The cell bottom of an aluminium production cell made up of carbon blocks was coated with a coating of titanium diboride as follows.

A slurry was prepared from a dispersion of 25 g $TiB_2$, 99.5% pure, −325 mesh (<42 micrometer), in 10 ml of colloidal alumina containing about 20 weight % of solid alumina. Coatings with a thickness of 150±50 to 500±50 micrometer were applied to the faces of the carbon blocks. Each layer of slurry was allowed to dry for several minutes before applying the next, followed by a drying by heating at 100°–150° C. for 30 minutes to 1 hour or more.

The above procedure can be repeated varying the amount of $TiB_2$ in the slurry from 5 to 40 g and varying the amount of colloidal alumina from 10 ml to 40 ml. Coatings were applied as before, and drying in air takes 10 to 60 minutes depending on the dilution of the slurry, the thickness of the coatings, the temperature and the humidity of the atmosphere. In all cases, an adherent porous layer of $TiB_2$ is obtained.

The coated carbon blocks were then placed under a layer of powdered carbon and heated at 900° C.–1000° C. for 18–36 hours, typically at 950° C. for 24 hours. This heating takes place in a furnace under air, but the presence of the carbon powder on the coating ensures that the coating is effectively exposed to a reducing atmosphere of $CO/CO_2$ containing nitrogen.

The aluminium-resistant and aluminium-wettable coating thus produced has a porosity of about 30%. The porous coating can be aluminized prior to use or is aluminized during use.

The aluminium production cell containing the cathode with an aluminium-wettable porous coating produced as described is heated up to 700°–900° C. and then filled with cryolite and aluminium and operated at 970° C. Alumina is fed by a known point feeding device at a rate of about 100 kg every hour which corresponds to 2.4 tons a day, for a cell output of about 1200 kg/day.

A typical alumina feedstock results in product aluminium containing 45 to 55 ppm of titanium and 4 to 6 ppm of boron, originating from the alumina. For an alumina feedstock which provides 50 ppm titanium and 4.5 ppm boron in the aluminium, the required added concentration of boron to produce the desired limiting titanium plus boron content of 63.5 ppm is 9 ppm. The addition of 9 ppm of boron requires the addition of $3.42 \cdot 10^{-2}$ kg/day of $B_2O_3$ for a cell producing 1200 kg/day.

This amount of $B_2O_3$ can be added daily or at regular intervals to the alumina feed to maintain the desired boron content.

During operation, the product aluminium is analyzed daily or at regular intervals to ascertain that the titanium and boron levels remain at suitable values, i.e. corresponding approximately to the solubility product.

In principle, operation will usually continue in a steady state until the alumina feed is changed when it is necessary to analyze the titanium and boron content and adjust the rate of addition of titanium and boron, as necessary.

EXAMPLE II

The cathode of an aluminium production cell was coated as described in Example I with a $TiB_2$ coating in a total amount of 161 kg of $TiB_2$ on the cell bottom.

The cell was started up and operated using an alumina feed which provided a background level of 14 ppm titanium and 3 ppm boron in the product aluminium. Each day 1150 kg of aluminium was tapped off from the cell. The titanium and boron levels in the product aluminium were measured and after 110 days operation averaged 47 ppm titanium and 19 ppm boron, i.e. just above the solubility product.

Based on a calculation of the amounts of titanium and boron removed from the cell, the coating life was extrapolated to be 8 years and 7.5 years respectively.

In accordance with the invention, titanium oxide and boron oxide are added to provide a titanium concentration of 35 ppm (i.e. adding an extra 16 ppm of titanium) and a boron concentration of 13.5 ppm (i.e. adding an extra 10.5 ppm of boron) in the molten aluminium, the total concentration from the feed being just below the solubility product.

Such addition of titanium and boron to the alumina feed does not increase the levels of titanium and boron in the product aluminium. However, it substantially increases the extrapolated lifetime of the coating.

With these additions, the calculated extrapolated lifetime of the coating increases to 22 years (based on the calculated titanium consumption) and 21.8 years (based on the calculated boron consumption).

Hitherto, no lifetime approaching this has ever been achieved or reported with the prior art titanium diboride coatings in a carbon binder, even when operating under supersaturation conditions to permanently maintain the coating. The exceptional lifetime achieved appears to be related to the great insolubility of the porous coatings containing titanium diboride and colloidal alumina, and may possibly be explained by the formation of extremely insoluble compounds.

It is understood that when a particular end use of the product aluminium dictates specific maximum concentrations of titanium or boron, it is possible to adjust the titanium concentration in the alumina feed and provide for the required concentration of boron as explained above, or maintain a low boron concentration and add extra titanium to the alumina feed to maintain the required total concentration.

As demonstrated, the total boron and titanium content can be maintained at a value to provide boron and titanium in the product aluminium just below the solubility product, in which case a very slow but acceptable dissolution of the titanium diboride from the coating can be expected.

We claim:

1. A cell for the electrowinning of aluminium by the electrolysis of alumina dissolved in a molten fluoride-based electrolyte, comprising:

a cathode composed of a carbon body having an aluminium resistant aluminium-wettable surface layer containing particulate refractory hard metal boride and a non-organic bonding material providing a porous layer which contains cathodic molten aluminium;

a feeder adapted for delivering alumina feedstock which includes refractory hard metal boride and boron; and molten cathodic aluminium in contact with the aluminium-resistant and aluminium-wettable surface of the carbon cathode, the molten aluminium external to the aluminium-resistant and aluminium-wettable surface, said molten aluminium containing refractory hard metal and boron fed into the cell in a total concentration varying from just above to just below that sufficient to inhibit dissolution into the molten aluminium of the refractory hard metal boride of the aluminium-resistant surface layer of the cathode.

2. The cell according to claim 1, wherein the refractory hard metal boride is titanium diboride.

3. The cell according to claim 1, wherein the bonding material comprises at least one colloid selected from colloidal alumina, silica, yttria, ceria, thoria, zirconia, magnesia, lithia, monoaluminium phosphate or cerium acetate.

4. The cell of claim 3, wherein the binder is colloidal alumina.

5. The cell of claim 1, wherein the aluminium-resistant and aluminium-wettable surface has a porosity of about 20% to about 40%.

6. The cell of claim 1, wherein the aluminium-resistant resistant and aluminium-wettable porous surface includes one or more layers of particulate refractory hard metal boride and bonding material followed by heat treatment.

7. A method of electrowinning aluminium in a cell, by electrolysis of alumina dissolved in a molten fluoride-based electrolyte, said cell comprising a cathode composed of a carbon body having an aluminium resistant aluminium-wettable surface layer containing particulate refractory hard metal boride and a non-organic bonding material providing a porous layer which contains cathodic molten aluminium and molten cathodic aluminium in contact with the aluminium-resistant and aluminium-wettable surface of the carbon cathode, the molten aluminium external to the aluminium-resistant and aluminium-wettable surface, said molten aluminium containing refractory hard metal and boron fed into the cell in a total concentration ranging from just above to just below that sufficient to inhibit dissolution into the molten aluminium of the refractory hard metal boride which forms part of the aluminium-resistant surface layer of the cathode, said method comprising:

delivering an alumina feed stock to the cell, wherein the refractory hard metal content and the boron content of the fed alumina is adjusted to bring the level of the refractory hard metal and boron supplied from the feed to the molten aluminum, to just above or just below the solubility product, thus inhibiting or substantially inhibiting dissolution into the molten aluminium of the aluminium-resistant surface layer of the cathode.

8. The method of claim 7, wherein the aluminium-resistant and aluminium-wettable porous surface of the carbon cathode contains titanium diboride.

9. The method of claim 8, wherein alumina is fed to the cell such that the required amount of titanium results from the alumina feed while the boron content of the fed alumina is increased by adding a quantity of a boron compound calculated to bring the total resulting titanium and boron content in the molten aluminium up to or just below the equilibrium solubility product, said calculation being based on the expected levels of titanium and boron in the product aluminium from the feed.

10. The method of claim 8, wherein at least one compound of titanium and boron is added to the alumina feedstock in an amount to bring the resulting level of titanium and boron in the product aluminium to just above or just below the solubility product, and the amount of the added compound(s) is adjusted whenever there is a change in the alumina feedstock.

11. The method of claim 8, wherein titanium and/or boron compounds are added to the alumina feed in an amount whereby the total titanium and boron content in the molten aluminium from the feed is below the solubility product by an amount allowing very slow dissolution of the surface layer of the cathode.

12. The method of claim 8, comprising:

operating the cell initially with an alumina feedstock which provides a known level of titanium and boron in the product aluminium well below the solubility product;

measuring the level of titanium and boron in the product aluminium so as to obtain a measured level of titanium and a measured level of boron;

adding at least one compound of titanium and boron to the alumina feed in an amount to bring the resulting level of titanium and boron in the product aluminium from the feed up to or just below the said measured levels; and continuing operation with addition of said amount of said at least one compound of titanium and boron to the alumina feed.

13. The method of claim 12, wherein said measured level of titanium and boron is slightly above the solubility product and the amount of added compound(s) is calculated to bring the resulting level of titanium and boron in the product aluminium from the feed up to said measured levels.

14. The method of claim 12, wherein said measured level of titanium and boron is slightly above the solubility product and the amount of added compound(s) is calculated to bring the resulting level of titanium and boron in the product aluminium from the feed up to the solubility product.

15. The method of claim 12, wherein said measured level of titanium and boron is slightly above the solubility product and the amount of added compound(s) is calculated to bring the resulting level of titanium and boron in the product aluminium from the feed to slightly below the solubility product.

16. The method of claim 12, wherein the amount of the compound(s) added is adjusted whenever there is a change in the alumina feed.

* * * * *

UNITED STATES PATENT AND TRADEMARK OFFICE

CERTIFICATE OF CORRECTION

PATENT NO. : 5,618,403
DATED : Apr. 8, 1997
INVENTOR(S) : de Nora et al.

It is certified that error appears in the above-indentified patent and that said Letters Patent is hereby corrected as shown below:

On page 9, line 13, please delete "boride".

On page 9, line 37, please delete "resistant".

On page 9, line 39, please delete "followed by heat treatment".

Signed and Sealed this

Eighteenth Day of November 1997

*Attest:*

Bruce Lehman

BRUCE LEHMAN

*Attesting Officer*

*Commissioner of Patents and Trademarks*